US005685636A

United States Patent [19]

German

[11] Patent Number: 5,685,636

[45] Date of Patent: Nov. 11, 1997

[54] EYE SAFE LASER SECURITY DEVICE

[75] Inventor: John D. German, Cedar Crest, N. Mex.

[73] Assignee: Science and Engineering Associates, Inc., Albuquerque, N. Mex.

[21] Appl. No.: 518,230

[22] Filed: Aug. 23, 1995

[51] Int. Cl.[6] ..... F21K 7/00

[52] U.S. Cl. ..... 362/259; 42/1.16; 42/100; 361/232; 362/8; 362/32; 362/102; 362/111; 362/187; 362/276; 362/294; 362/802

[58] Field of Search ..... 42/1.08, 1.16, 42/100, 103; 273/84 ES, 84 R; 361/232; 362/3, 8, 11, 12, 32, 102, 109–114, 183, 187, 259, 276, 294, 800, 802

[56] References Cited

U.S. PATENT DOCUMENTS

| | | | |
|---|---|---|---|
| 3,891,966 | 6/1975 | Sztankay | 340/903 |
| 4,186,851 | 2/1980 | Cantor | 222/113 |
| 4,340,617 | 7/1982 | Deutsch et al. | 427/581 |
| 4,842,277 | 6/1989 | LaCroix | 273/84 ES |
| 4,843,336 | 6/1989 | Kuo | 361/232 |
| 4,916,579 | 4/1990 | Simms | 362/259 |
| 4,933,816 | 6/1990 | Hug et al. | 362/32 |
| 5,072,342 | 12/1991 | Minovitch | 362/111 |
| 5,119,576 | 6/1992 | Erning | 42/103 |
| 5,222,798 | 6/1993 | Adams | 362/110 |
| 5,237,773 | 8/1993 | Claridge | 42/103 |
| 5,243,894 | 9/1993 | Minovitch | 362/111 |
| 5,343,376 | 8/1994 | Huang | 362/259 |
| 5,347,431 | 9/1994 | Blackwell et al. | 362/11 |
| 5,364,097 | 11/1994 | Lyon | 273/84 R |

*Primary Examiner*—Alan Cariaso

*Attorney, Agent, or Firm*—DeWitt M. Morgan, Esq.; Kevin Lynn Wildenstein, Esq.

[57] ABSTRACT

This invention provides a fixed or portable non-lethal laser security device and method for use of such device as a non-damaging weapon and security system to provides warning and visual impairment upon an intruder. At a predetermined laser wavelength and intensity, this invention utilizes laser light in the visible portion of the wavelength spectrum to create temporary visual impairment, hesitation, delay, distraction, and reductions in combat and functional effectiveness through the effects of glare, flashblind, and psychological impact. The preferred embodiment of the laser security device in the present invention involves the use of laser technology with a remotely operated security system. The device should have a housing structure to protect the internal components from damage or destruction, the ability to produce and transmit visible laser light over various wavelengths and intensities, a power source to drive the laser light, a collimating lens to focus the laser light, and should also be capable of coupling and communicating with an existing security device such as a remote-control closed circuit television camera mounted upon a pan and tilt head. Upon detection of an intruder, the laser security device is capable of visually warning the intruder of the detection. If the intruder further intrudes, the laser security device impairs the intruder's visual capabilities by the effects of flashblind and glare, allowing security forces time to respond to the intrusion and intercept the intruder.

34 Claims, 9 Drawing Sheets

EYE SAFE LASER SECURITY DEVICE

The U.S. Government has a paid-up license in the invention as depicted in FIGS. 3 and 4 of the present invention and the right in limited circumstances to require the patent owner to license others under claims directed to the embodiment of FIGS. 3 and 4 of the present invention on reasonable terms.

FIELD OF THE INVENTION

This invention relates to non-lethal, non eye damaging laser security devices and the use of such devices as non-damaging weapons and security systems to provide warning and visual impairment. Specifically, these devices utilize visible laser light at predetermined wavelengths and intensities to create temporary visual impairment (by glare and/or flashblinding) to cause, hesitation, delay, distraction, and reductions in combat and functional effectiveness when used against humans in military, law enforcement, corrections (prisons) and security applications.

BACKGROUND OF THE INVENTION

In the present domestic and world political climate, U.S. military forces are faced with a growing number of situations in which less-than-lethal response options are essential. Recent examples include Somalia, Cuban refugee camps and Haiti, as well as the riots in Los Angeles. In these types of situations, where military, political and humanitarian objectives preclude the use of lethal force except when personnel are in immediate danger, the individual soldier must have less-than-lethal options available to him or her to warn, deter, delay, or incapacitate a wide range of adversaries.

I have determined that low-energy lasers can be effective, non-lethal weapons for a variety of military missions as well as civilian law enforcement applications. Through the effect of illumination, glare, flashblinding and psychological impact, lasers can create hesitation, delay distraction, temporary visual impairment, and reductions in combat and functional effectiveness when used against local inhabitants trying to steal supplies, intruders, military and paramilitary forces, terrorists, snipers, criminals and other adversaries. Further more, if continuous-wave (cw) or repetitively pulsed lasers, having the required intensity are used these effects can be created at eye-safe exposure levels below the maximum alloy by international safety standards. The low-energy laser systems used to produce these effects are called laser visual countermeasure (LVCM) devices.

Laser visual countermeasure devices can provide the individual soldier with a unique array of non-lethal response options that can be increased in severity as the situation warrants. These options are:

- Unequivocal, Language-Independent Warning—A 1 to 2 foot diameter spot of bright red light illuminating the adversary's chest makes it clear that he has been spotted, singled out, and may have lethal weapons aimed at him.
- Threat Assessment Based on Reaction to Warning—The intent/motivation of the threat and the need for a more severe response can be assessed based on whether the adversary surrenders, retreats, continues to advance, or raises a weapon in response to the warning.
- Slowing or Stopping the Advance of Individuals on Foot or in Vehicles Through Temporary Visual Impairment—Laser glare and flashblinding, make it difficult to see a path, road, or obstacles, especially at night.

- Impairing an Adversary's Ability to See in the General Direction of the Laser—Adversaries looking towards the laser source can see little or no detail about the location and placement of opposing forces.
- Interfering With an Adversary's Ability to Accurately Aim a Firearm and Engage in Other Combat Tasks—Weapon firing accuracy is severely degraded by laser glare.

Specific applications for which such lasers could enhance effectiveness include perimeter security for military and industrial facilities, apprehension of unarmed but violent subjects, protection from suspected snipers, and crowd/mob control. Another important class of applications are those which limit the use of potentially lethal weapons because innocent people are present. These include hostage situations, protection of political figures in crowds, airport security, and prison situations where guards are present. A similar situation occurs when use of firearms or explosives may cause unacceptable collateral damage to equipment or facilities, such as aircraft or electronic equipment. Finally, there are applications, such as raids on hostile facilities and hostage rescues, where even a few seconds of distraction and visual impairment can be vital to the success of the mission.

Until recently, the relatively large size of laser-producing components have prevented the use of laser technology in personal protection or security applications. In recent years, however, compact laser-producing components have made the benefits of laser technology available to numerous applications, such as compact disc players, medical tools and welding appliances.

Lasers are capable of a wide range of effects on human vision which depend primarily on the laser wavelength (measured in nanometers), beam intensity at the eye (measured in watts/square centimeter), and whether the laser is pulsed or continuous-wave ("cw"). These effects can be divided into three categories: (1) glare; (2) flashblinding; and (3) retinal lesion. The present invention relates to the use of eye-safe lasers for glare and flashblinding.

The glare effect is a reduced visibility condition due to a bright source of light in a person's field of view. It is a temporary effect that disappears as soon as the light source is extinguished, turned off or directed away from the subject. If the light source is a laser, it must emit laser light in the visible portion of the wavelength spectrum and must be continuous or rapidly pulsed to maintain the reduced glare visibility effect. The degree of visual impairment due to glare depends on the ambient lighting conditions and the location of the light source relative to where the person is looking. In bright ambient lighting, the eye pupil is constricted, allowing less laser light into the eye to impair vision. Also, if the laser is not near the center of the visual field, it does not interfere as much with an individual's vision.

In contrast, the flashblind effect is a temporary reduction in visual performance resulting from exposure to any intense light, such as those emitting from a photographic flashbulb or a laser. The nature of this impairment makes it difficult for a person to discern objects, especially small, low-contrast objects or those objects at a distance. The duration of the visual impairment can range from a few seconds to several minutes, and depends upon the amount of laser intensity employed, the ambient lighting conditions and the person's visual objectives. The major difference between the flashblind effect and the glare effect is that visual impairment caused by flashblind remains for a short time after the light source is extinguished, whereas visual impairment due to the glare effect does not.

If the intensity of a laser beam at the eye exceeds a certain level, permanent damage to the retina can occur in the form of lesions (i.e., small burns at the focal spot of the laser beam). In general, the long term visual impairment from such lesions is minimal unless the lesion occurs in the small central region of the retina which is responsible for detailed vision. To differentiate eye-damaging laser exposures from eye-safe laser exposures, international laser safety organizations have defined safety standards based on experimental tests with humans and animals.

The definitive laser safety parameters as defined by the American National Standards Institute in ANSI Z136.1-1993, is the Maximum Permissible Exposure (MPE). It is not a fixed number but varies with the laser wavelength, pulse length, repetition rate (for pulsed lasers) and length of exposure. For visible, continuous and repetitively pulsed lasers the key factors related to laser safety are the intensity of the beam at the eye and the length of exposure. The relationships between these two parameters, the MPE, and the eye-damage threshold is illustrated in FIG. 1 for visible laser beams. Note that the MPE and eye-damage threshold are not fixed numbers; they vary with the length of exposure. The shaded region in FIG. 1 shows the regime for eye-safe flashblind and glare. The eye damage threshold defines the upper boundary of this regime, while the lower boundary of 0.0001 Watts per square centimeter is the lower limit of intensity for any useful degree of glare and flashblinding. The left boundary is defined by a minimum exposure time for flashblinding of 0.01 seconds. For pulse shorter than this, the eye does not respond sufficiently for useful effects to occur.

Within the eye-safe range indicated above, the key factor in the effectiveness of a given laser as a security device is how bright the laser appears to the eye. The apparent brightness is a function of the laser intensity at the eye and the laser wavelength. The intensity at the eye can be optimized rather easily by control of the laser output power level and laser beam size. The wavelength, however, is a function of the type of laser and is therefore more severely constrained by the limited laser options available which are suitable for the security device applications of the present invention.

The wavelength at which the human eye is most sensitive depends on whether the eye is initially adapted to light or dark conditions. FIG. 2 shows the relative response of the human eye to light of different wavelengths for both nighttime and daytime light conditions. Ideally, the wavelength of the laser should operate at a wavelength near the peak response to maximize the visual impairment effects. The wavelength of peak eye sensitivity during daylight is about 560 nanometers("nm"), while the peak sensitivity in the dark is about 510 nanometers. Thus, the ideal laser for applications involving both light and dark conditions would operate at about 530 nanometers, which is in the middle of the green portion of the wavelength spectrum. However, as those in the human vision scientific/medical community will appreciate, any wavelength between 400 and 700 nanometers can produce significant flashblinding and glare effects.

The prior art devices which employ light or laser technology can be categorized into three areas: (1) non-laser weapon devices employing bright lights or strobe lights; (2) low-power laser devices used for aiming or practicing with conventional firearms; and (3) high-energy pulsed laser weapon devices. The non-laser (e.g., bright light) weapon devices suffer from extremely limited range. Similarly, the laser aiming and practicing devices are not powerful or bright enough to cause the effects demonstrated with the present invention. Finally, high-energy pulsed weapons can cause significant or permanent eye damage because of the high peak intensity (watts/cm$^2$) inherent in pulsed laser beams.

Several patents have been granted for non-laser devices designed to the effects of flashblind or glare. For example, see U.S. Pat. No. 4,843,336; U.S. Pat. No. 5,222,798; U.S. Pat. No. 4,186,851; and U.S. Pat. No. 5,243,894. These patents use flashtubes or miniature light bulbs to create flashes of light or continuous light beams for the purpose of visually impairing an adversary. The primary disadvantage of these devices is the limited range of effectiveness, because they do not possess the narrow beams that are characteristic of lasers. Indeed, as seen in U.S. Pat. No. 4,186,851, the longest effective range taught in any of these prior art teachings is 10 feet. In contrast, the maximum tested range of the remotely operated laser security system in the present invention is in excess of 200 meters, and even at this range, the present invention is fully functional and effective.

Similarly, patents related to laser devices mounted on or in conventional firearms serve as either laser aiming lights (such as a laser sight) or laser proficiency training devices. For example, see U.S. Pat. No. 5,237,773 and U.S. Pat. No. 5,119,576. Although neither of these patents identify the power level of the lasers employed, there are several commercial brands of such laser devices now on the market (e.g. several models manufactured and marketed by Laser-Devices, Inc. of Monterey, Calif.). The disadvantage of these devices on the market is that they are limited to less than 5 milliwatts (0.005 watts) of laser output power. Conversely, to achieve the flashblind and glare effects provided by the present invention requires at least 100 milliwatts (0.1 watts) of laser output power. Therefore, a need exists for a security device with ample power which is also functional over a long distance.

Due to compact, highly efficient laser-producing components, the present invention provides an effective and safe security device for either portable or fixed applications. Portable laser security devices are useful where mobility or temporary perimeter security is important. For existing portable security devices, the present invention can either be incorporated into existing security devices, such as a conventional firearm, or can be incorporated into smaller, less obvious security devices, having the shape of a conventional flashlight or police baton. The use of eye-safe laser visual countermeasure devices can be beneficial in a variety of applications including law enforcement, prison security and prisoner handling, hostage rescue, protection of political VIPs, and security of activist/terrorist targets such as nuclear power plants, airports, and embassies.

Likewise, the present invention may be in the form of fixed or mounted security devices permanently installed to provide a visual defense system for highly secure facilities, such as nuclear power plants, embassy buildings, military weapons storage sites, bank vaults, communication centers, computer centers and even residential protection. For existing fixed security devices, the present invention can either be incorporated alongside existing security devices, such as a surveillance video camera attached to a remote closed circuit television monitor. Similarly, the present invention can be incorporated alongside smaller, less obvious fixed security devices such as a motion detector.

Accordingly, it is an object of the present invention to provide a non-lethal security device having a laser to create temporary visual impairment of a potential adversary or intruder, without permanent eye damage or corneal burn.

It is a further object of the present invention to provide a non-lethal security device which utilizes laser light at a predetermined wavelength and intensity to provide visual warning to potential adversary or intruder, which results in hesitation, delay, distraction, surrender or retreat.

It is also an object of the present invention to provide a portable non-lethal security device having a laser of predetermined wavelength and intensity to provide visual warning to potential adversary or intruder, which results in hesitation, delay, distraction, surrender or retreat.

It is also an object of the present invention to provide a fixed non-lethal security device to provide visual warning to potential adversary or intruder, which results in hesitation, delay, distraction, surrender or retreat.

SUMMARY OF THE INVENTION

One embodiment of the eye-safe laser security device in the present invention includes a hand held housing structure to protect the internal components from damage or destruction, the ability to produce and transmit visible laser light or various intensities, a power source to drive the laser, and a lens to adjust the size and intensity of the laser beam.

In another embodiment, the present invention consists of a laser coupled with a CCTV camera on a remotely operated pan and tilt head. This system allows a remotely located security guard to aim the CCTV camera (via an operator console) at suspected intruders as they enter a secured area and illuminate them with a visible laser beam to provide a clear, unequivocal warning to the intruder. If the intruders choose to continue, the system will impair their ability to progress in an efficient and timely manner by the visual effects of glare and flashblind. The corresponding delay by the intruder will give security forces time to respond and intercept the intruders before they can escape. Due to the nature of the laser employed, this embodiment (as well as other embodiments) has the capability to operate either in the day or at night regardless of the surrounding ambient lighting conditions. The system will also highlight intruders through visible laser light for the security forces to observe and will also impair the intruder's ability to see or physically attack the security forces.

The secured area can be either an indoor facility, such as a bank or government building, or an outdoor area such as a military base or industrial site. Furthermore, the operator console could be connected to several remote systems so that a large facility could be protected at several locations by a single security guard. Additionally, by allowing a single security guard to operate the operator console to warn and delay intruders, it is possible to reduce the size of the security force, resulting in cost savings. Finally, by providing non-damaging response options, the chance of injuring a non-threatening intruder (such as an innocent bystander) is greatly reduced, with a subsequent reduction in possible legal expenses and public outcry.

DESCRIPTION OF THE PREFERRED EMBODIMENTS

Figure 3:
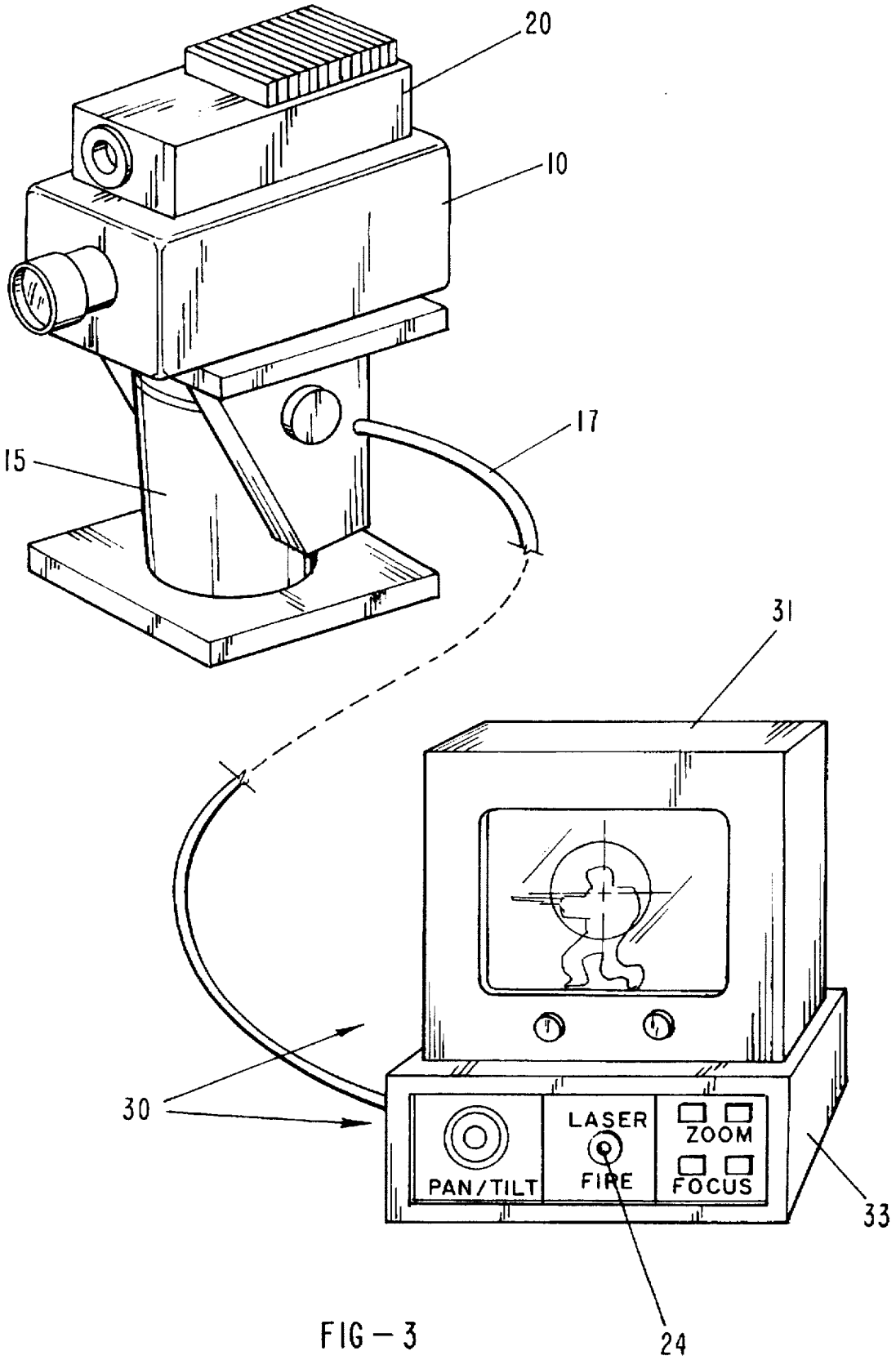
FIG. 3 is a perspective view of one of the preferred embodiments of the present invention.

The remotely operated laser security system shown in FIG. 3, consists of a CCTV camera 10, a laser unit 20, a pan and tilt camera mount 15, and a remotely located operator console 30. CCTV camera 10 and laser unit 20 communicate with operator console 30 via conventional cabling 17. Operator console 30 can comprise a single unit, or can comprise conventional television monitor 31 and conventional operator control unit 33. Operator control unit 33 controls the operation of CCTV camera 30, laser unit 20, and pan and tilt mount 15. With the exception of laser operator switch 24 added to operator console 30, CCTV camera 10, pan and tilt mount 15 and operator console 30 are entirely conventional in design and are available from several commercial suppliers, such as the Model PT123R manufactured and marketed by Pelco of Clovis, Calif. Laser operator switch 24 is of conventional design and is easily added to any of the commercial hardware.

Figure 4:
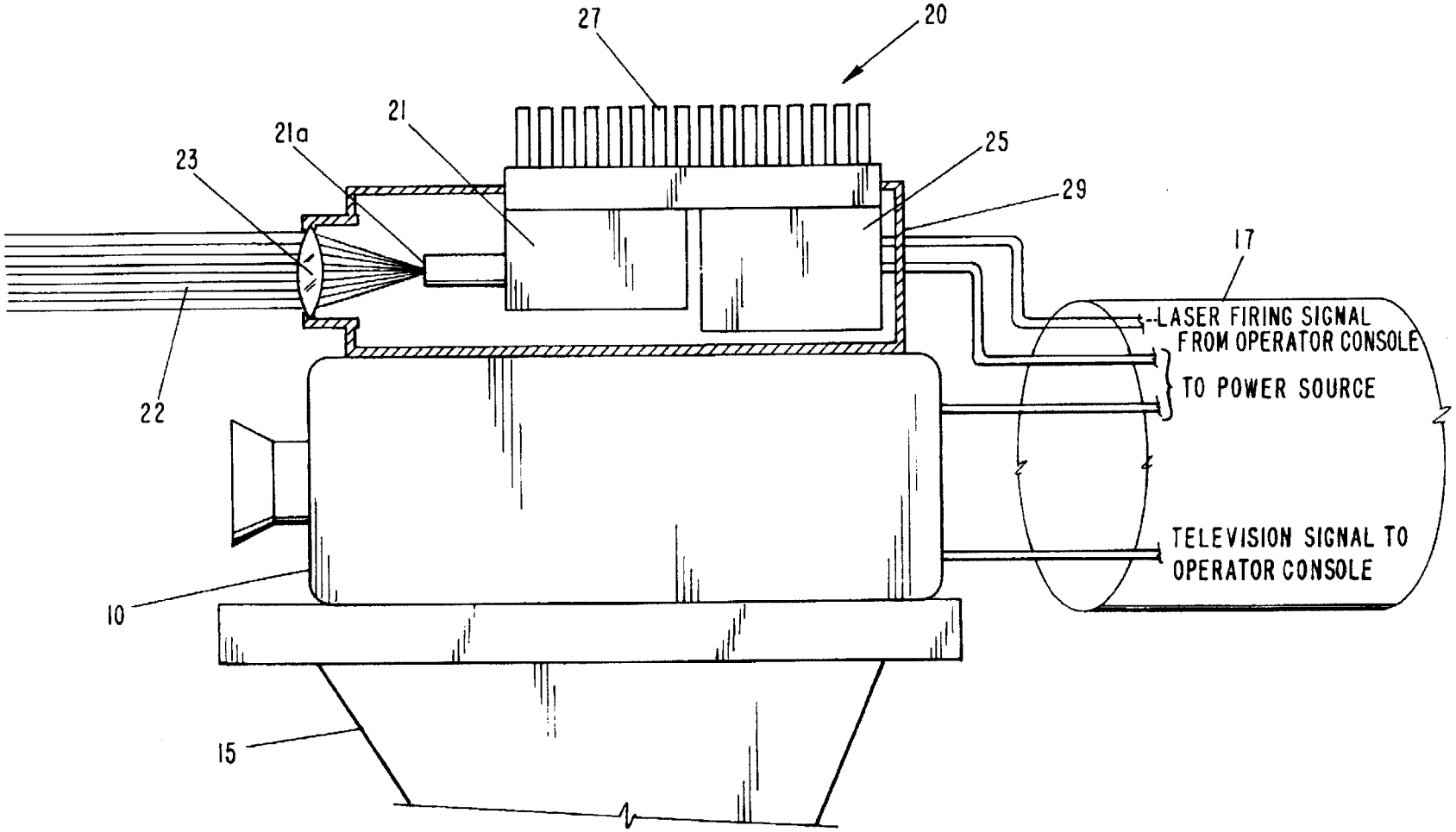
FIG. 4 is a side, partially cross-sectional, view of the camera and laser of FIG. 3.

As seen in detail in FIG. 4, laser unit 20, which is also constructed from commercially available components, consists of semiconductor diode laser 21, laser output apparatus 21*a*, collimating lens 23, laser power supply 25, finned aluminum heat sink 27, and housing unit 29. Diode laser 21 is the primary component of laser unit 20. In this embodiment, is a continuous wave semiconductor diode laser array that emits 0.5 to 2.0 watts of visible laser light. This power level was found in tests to be ideal for providing sufficient brightness in a large beam spot (50 to 100 cm diameter) to get an intruders attention in daylight at ranges of 100 to 200 meters. Commercial units available which meet these requirements include Model SDL-7470-P5 (manufactured by Spectra Diode Labs, Inc.) and the DLC-3200 (manufactured by Applied Optronics Corp.). Both of these units operate at a wavelength of 670 nanometers and produce a beam that is deep red in color. Although shorter laser wavelengths (e.g. orange, yellow, or green colors) would be more effective at producing glare and flashblind, semiconductor diode lasers capable of producing these wavelengths at 0.5 to 2.0 watts of power are not yet available. Limited power versions (less that 5 milliwatts of light output) of such lasers have been produced in the laboratory, and should be available commercially in higher powers within 5 years. As an alternative to employing a semiconductor diode laser, a continuous-wave frequency-doubled neodymium-YAG laser could be used. These lasers, which are commercially available (Santa Fe Laser Corp. Model C-140-D), produce laser light in the green portion of the wavelength spectrum (532 nanometers) and are optimum for producing the flashblind and glare effects. Those skilled in the art will appreciate that wavelengths ranging from approximately 400 nanometers to 700 nanometers (approximately the visible portion of the wavelength spectrum) can be employed to induce the effects of glare or flashblind.

As depicted in FIG. 4, laser beam 22 from laser unit 20 is transmitted out of the semiconductor diode laser array 21 through a short optical fiber (not shown) that is an integral component of the semiconductor diode laser package as supplied by the manufacturer. Because laser beam 22 exits the fiber bundle with a wide divergence angle, collimating lens 23 is required to reduce laser beam 22 spread. Collimating lens 23 is focused by adjusting its position to provide a laser beam diameter of approximately 50–100 centimeters at the location of an intruders, typically 100 meters away. Laser power supply 25 is a commercially available, current-controlled power supply capable of converting available electrical power (either 24 volts or 115 volts alternating current for most security camera systems) to direct current as required by semiconductor diode laser 21. Power supply 25 receives alternating current power from any conventional power source (such as from a building) through data cabling 17 (shown in FIGS. 3 and 4). Because laser unit 20 and power supply 25 generate heat that must be dissipated, both are attached to finned heat sink 27, which is also commercially available.

All of the above components are contained in a sealed, weatherproof aluminum housing 29 that can be custom-designed for any application. An alternative to using housing 29 would be to enclose both the CCTV camera 10 and the laser unit 20 inside a single housing enclosure.

In operation, a security guard monitors remotely located monitor 31 at operator console 30, via conventional pan and tilt controls. When he observes one or more suspected intruders, he aims the camera/laser combination at the body of one of the intruders and energizes laser unit 20 for a few seconds as a warning. The intruders will see a large (approximately 50–100 centimeter diameter) laser beam 22 illuminating them. If the intruders attempt to move, the operator can follow them with the visible laser beam by pan and tilt control on the operator control unit 33. At this point, it would be obvious to the intruders that they have been detected and, because the laser beam moves with them, that they are under observation. All but the most intent intruders will either turn and run, or surrender. An important issue in physical security is early intruder assessment, so that the security forces can adjust their response based on the intruders' intentions. The intruders' response to this initial warning will help with this assessment process. If the intruders do not retreat or surrender after seeing the unequivocal warning, it would be an indication that they are serious intruders who will risk being physically harmed to accomplish their goal.

If the intruders continue towards their goal, the security guard engages laser unit 20 again and aims it at the intruder's eyes. The flashblind and glare effects produced by laser beam 22 make it more difficult for the intruders to move quickly or to see any arriving security forces. When looking back towards laser beam 22 during daylight, it is very difficult to see things in the direction of laser unit 20; at night, it is almost impossible to see anything when looking in the general direction of laser unit 20. If the intruders are armed and choose to engage the security forces in a gun battle, the flashblind and/or glare from laser unit 20 will greatly reduce their ability to hit specific targets coming from the direction of laser unit 20.

Figure 5A:
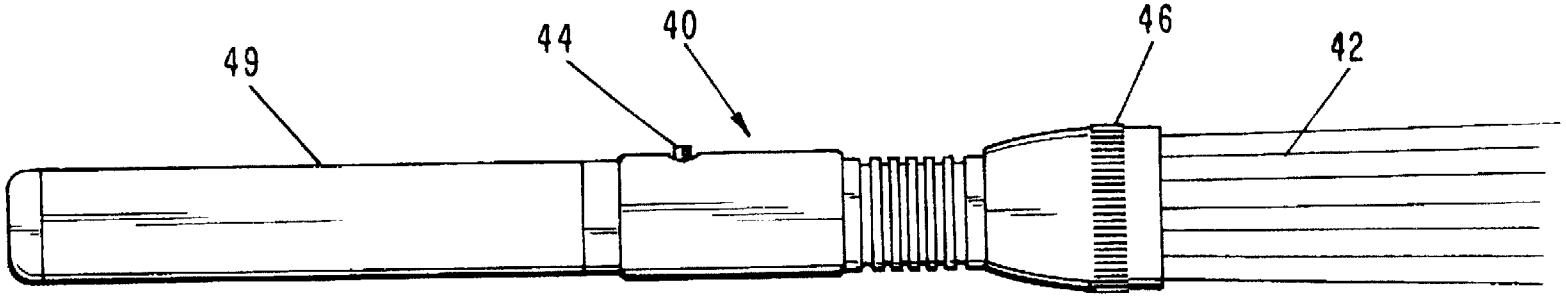
FIG. 5*a* is a side view of an alternate embodiment of the present invention.
Figure 5B:
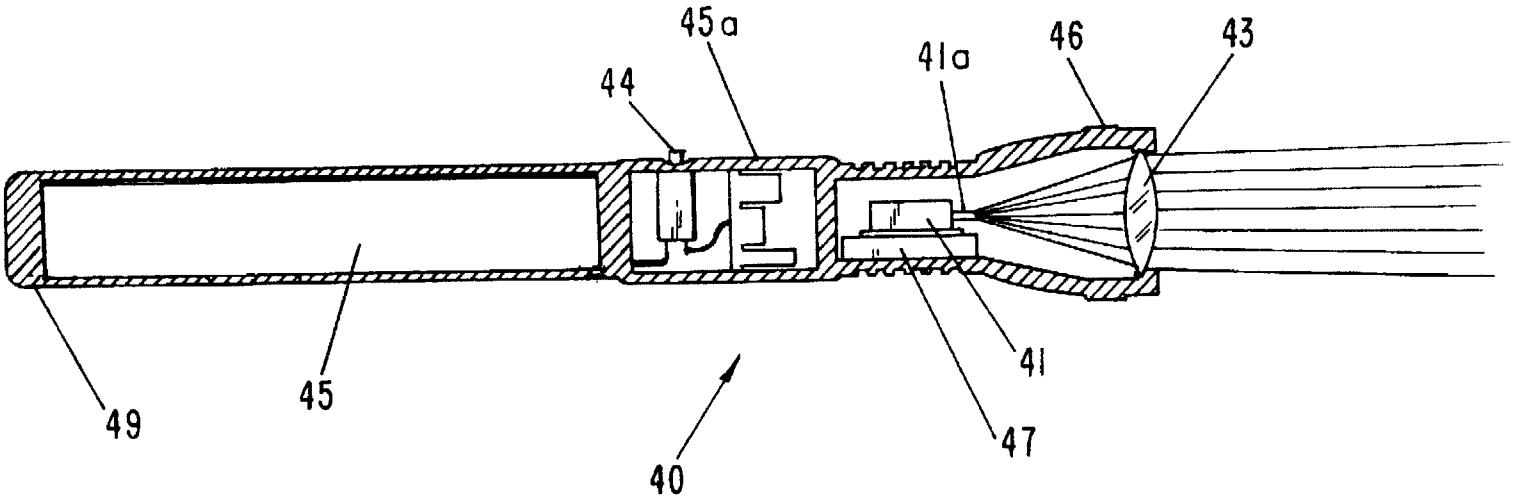
FIG. 5*b* is a cross-sectional side view of the embodiment shown in FIG. 5*a;*

An alternate embodiment of the present invention is a laser flashlight as shown in FIGS. 5*a* and 5*b*. The component parts of laser flashlight 40 include flashlight housing 49, power source 45, operator switch 44, laser power supply circuit 45*a*, semiconductor diode laser 41, heat sink 47, collimating lens 43, and focus ring 46.

The function of flashlight housing 49 is to protect the internal components and provide a rigid framework for supporting the optical components. It can be constructed of any lightweight, rigid material such as aluminum or plastic and may fabricated in sections that thread into one another. It is similar in appearance to many of the commercially aluminum flashlights now used by law enforcement officers and military personnel.

Three size "D", "C", or "AA" flashlight batteries can form power source 45 for semiconductor diode laser 41, and are disposed in the rear of flashlight housing 49. These batteries provide from 3 to 4.5 volts dc to laser power supply circuit 45*a*. Because of the high current (approximately 1 to 2 amperes) required by the diode, alkaline batteries or rechargeable nickel-cadmium are necessary. As the batteries decrease in voltage with use, the function of laser power supply circuit 45*a* is to provide steady state, current-controlled power to diode laser 41. Any textbook constant-current dc power supply design can be adapted for this application.

Figure 1:
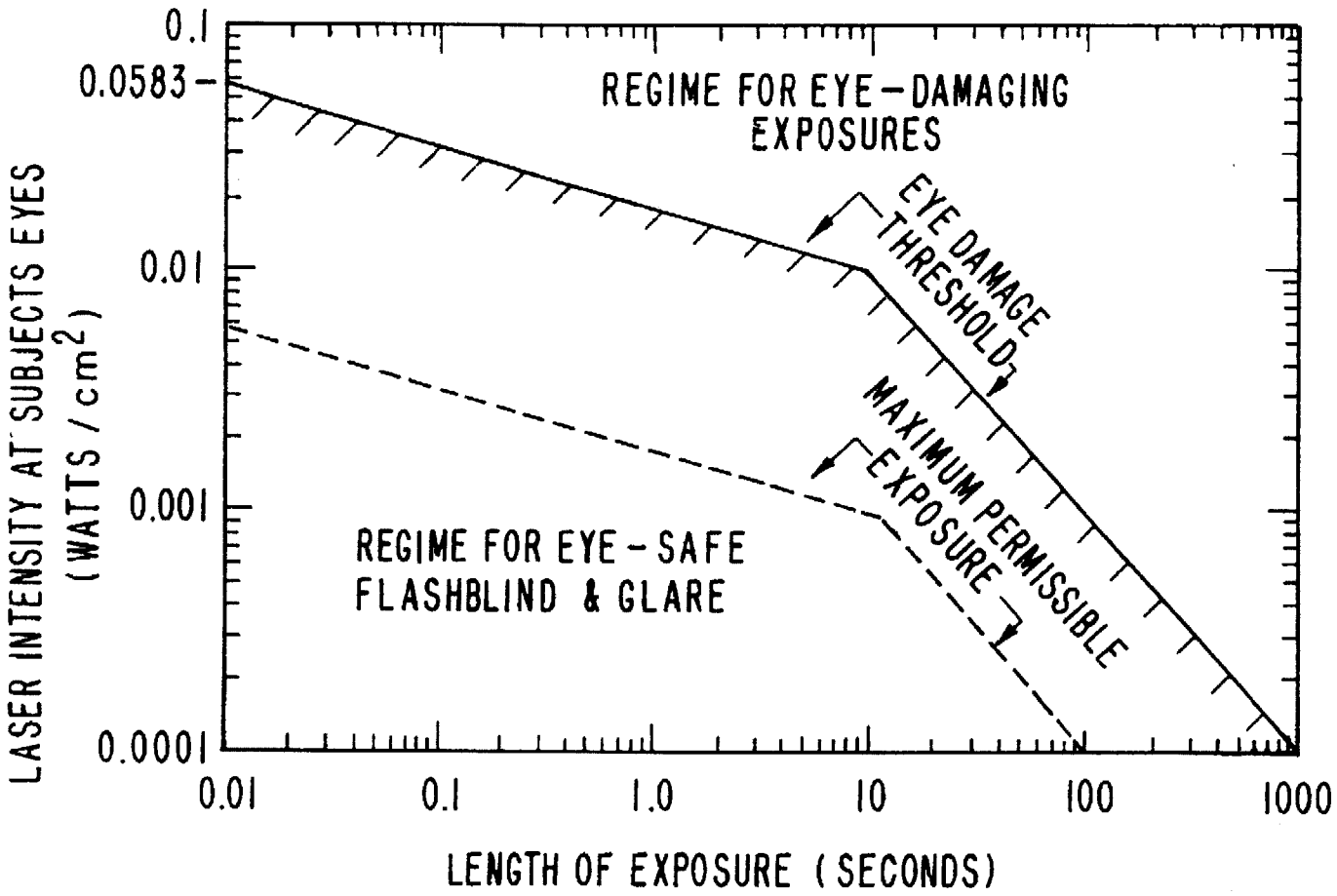
FIG. 1 is a graph illustrating the relationship between intensity of the beam at the eye, length of exposure, MPE, and the eye damage threshold.
Figure 2:
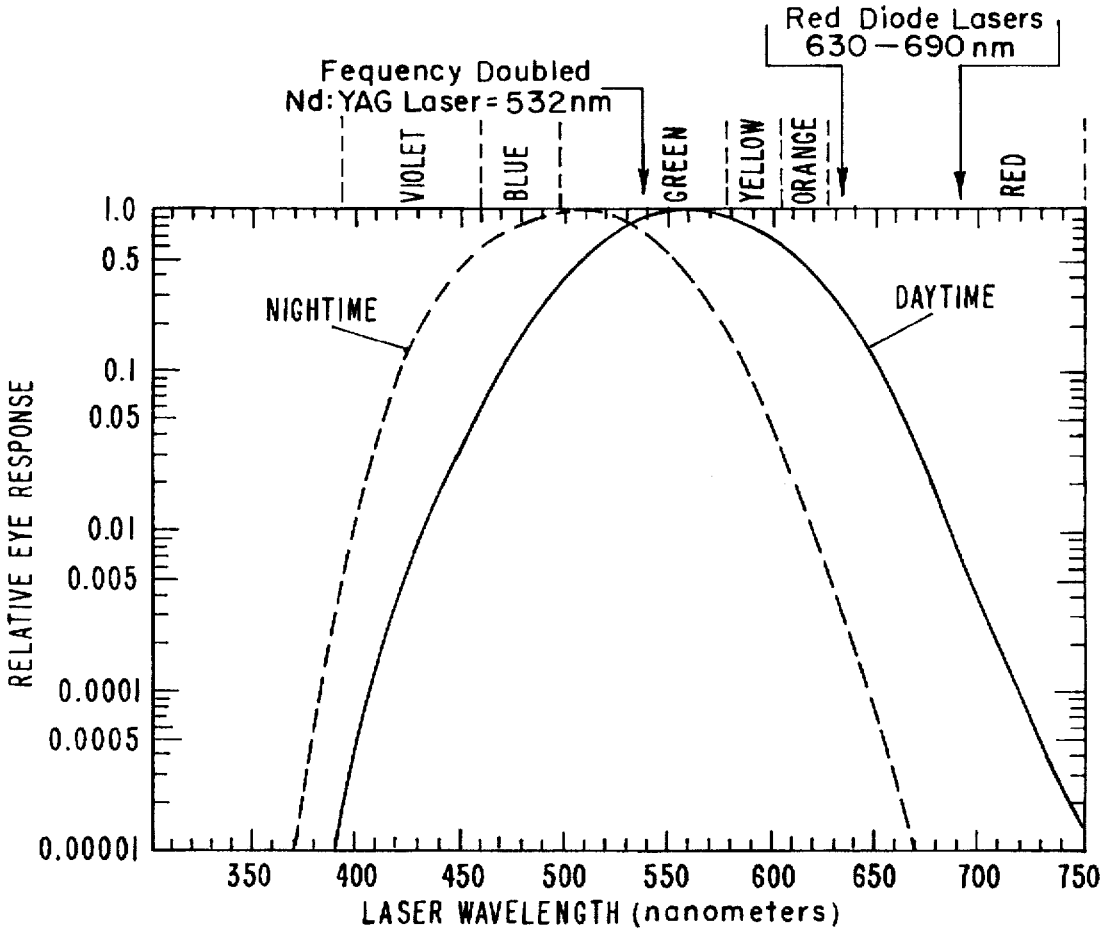
FIG. 2 is a graph depicting a human eye response when subjected to laser light over a range of frequencies.

Semiconductor diode laser 41 produces the bright, visible light required for the visual countermeasure effects. It is a continuous wave semiconductor diode laser capable of emitting ¼ to 1 watt of visible laser light. This power level was found in tests to be sufficient for producing a bright, large spot (10–25 cm diameter) at ranges of interest for the flashlight laser (i.e., 10–100 meters). Referring to FIG. 1, a 1 watt laser in a 25 cm diameter spot will provide an average intensity of about 0.002 watts per square centimeter. This produces glare and some residual flashblinding when the laser is turned off. Currently available commercial semiconductor diode lasers that meet these requirements include Model AOC 670-250-BM-100 manufactured by Applied Optronics Corporation. As with the first preferred embodiment, current technology cannot provide semiconductor diode lasers that operate at the optimum wavelength spectrum for visual countermeasures. However, as those skilled in the art can appreciate, future advances in this area will improve the effectiveness of all embodiments of this invention.

Because semiconductor diode lasers are between 10–45% efficient at producing light, they also produce significant waste heat, which reduces the performance of the lasers and shortens their lifetime. Heat sink 47 must, therefore, be provided to carry the heat away from diode laser 41. In a device such as laser flashlight 40 which will be used intermittently rather than for long periods of time, a simple copper, aluminum or brass block 47 thermally connected to the aluminum barrel of housing 49 is an adequate heat sink.

As laser light 42 emitted from diode laser 41 (having a laser output aperture 41*a*) is highly divergent, collimating lens 43 is needed to collimate laser beam 42 so that a useful spot size (e.g. 10–50 centimeters) can be projected on the intended target. A conventional short focal length (approximately 50 millimeters), double-convex lens, available from a number of commercial optical suppliers, is sufficient. To increase the output power transmitted by lens 43, it can have an anti-reflective coating at the laser wavelength. The beam spot size at the intended target is adjusted by rotating threaded lens holder portion 46 of housing 49.

Naturally, housing 49 can serve to shelter and protect the above mentioned internal components. Conversely, a separate housing unit within laser flashlight 40 (not shown) can serve to protect the internal components. As those skilled in the art will understand, the number of housing units employed to protect the internal components is purely a design choice. However, though housing 49 may be constructed from multiple pans, from the end user's standpoint there is only a simple housing.

In use, flashlight laser 40 is employed by, typically, law enforcement officers, security guards, prison guards, or military personnel. When encountering a criminal or being confronted by a threatening individual, the officer points flashlight laser 40 at the adversary's chest and turns laser unit 40 on with operator switch 44. This act can be accompanied by a verbal warning by the officer to make it clear to the adversary that more severe responses may follow. If the adversary does not surrender at that point, the officer redirects laser beam 42 to the adversary's eyes briefly to produce temporary visual impairment. If the adversary is unarmed, the officer or his associates can take advantage of the visual impairment to physically apprehend and handcuff the adversary. If the adversary attempts to use a firearm, the officer can continue to shine the laser beam in the adversary's eyes to reduce his ability to aim and accurately respond by firing his own weapon.

Figure 6A:
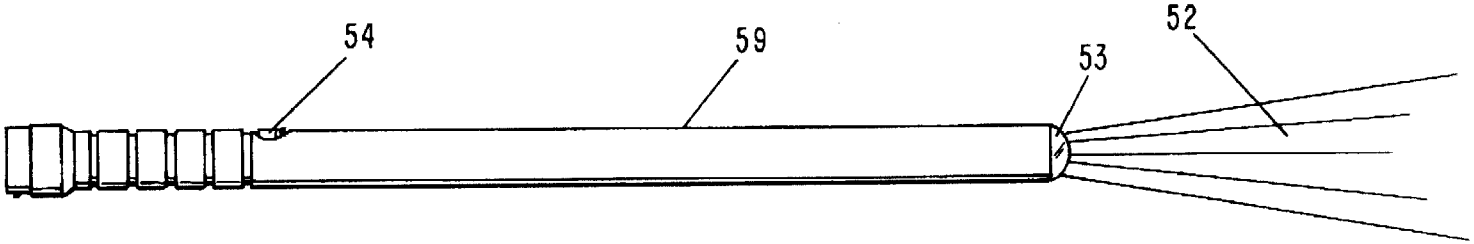
FIG. 6*a* is a side view of another alternate embodiment of the present invention.
Figure 6B:
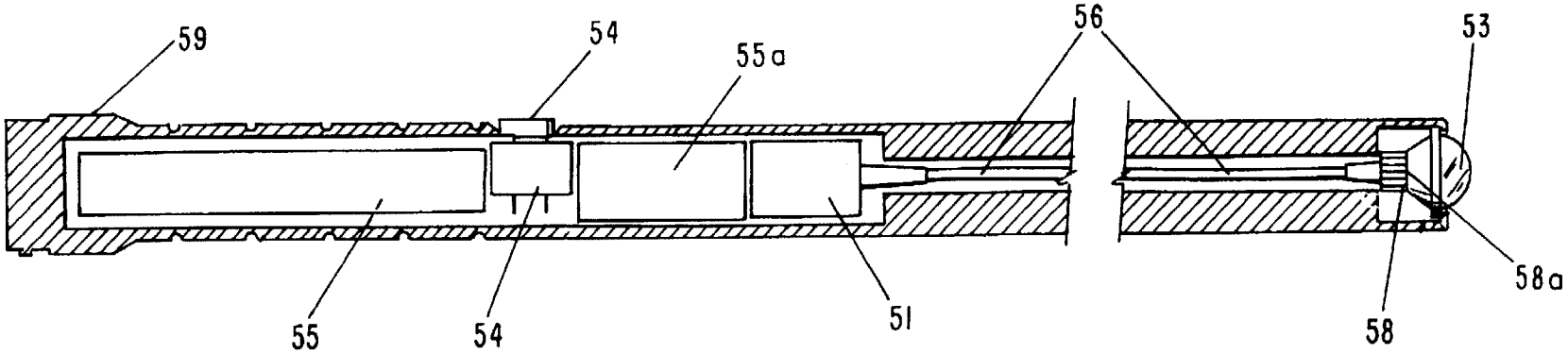
FIG. 6*b* is a cross-sectional side view of the embodiment show in FIG. 6*a;*

A laser baton, another alternate embodiment of the present invention, is shown in FIGS. 6*a* and 6*b*. The component parts of the laser baton include baton housing 59, power source 55, operator switch 54, laser power supply circuit 55*a*, semiconductor diode laser 51, optical fiber 56, optical fiber output aperture 56*a*, fiber optic connector 58 and collimating lens 53.

The function of baton housing 59 is to protect the internal components and provide a rigid framework for mounting the optical components. In addition, it must be rigid enough to be fully capable of being used as a conventional police baton. Therefore, it can be constructed of any lightweight, rigid material such as aluminum or plastic. From outward appearances, it looks like any other conventional police baton except for collimating lens 53 in the tip of the baton and operator switch 54 in the baton handle. Similar to laser flashlight housing 49, baton housing 59 can serve to shelter and protect the internal components, or a separate internal housing unit (not shown) can serve to protect the internal components. While it may be constructed of more than one housing sections or components, from the end user's standpoint it functions as a single housing. As used in this application,"single housing" refers to the final product, even though such a housing may, when disassembled, comprise more than one piece or components.

Two size"AA" alkaline penlight batteries can serve as power source 55 for laser diode 51, and are located in the rear of housing 59. These batteries provide from 2.0 to 3.0 volts dc laser power supply circuit 55*a*. Because of the high current (approximately 1 to 2 amperes) required by diode laser 51, alkaline batteries or rechargeable nickel-cadmium are necessary. The laser power supply circuit 55*a* provides steady, current-controlled power to diode laser 51 as the batteries decrease in voltage with use. Of course, a single commercially available battery can serve as a power source if it complies with the power requirements as set forth in the present invention. Semiconductor diode laser 51 produces the bright, visible light required for visual countermeasure effects, and is similar to that used in flashlight laser 40. A continuous wave semiconductor diode laser 51 capable of emitting ¼ to 1 watt of visible laser light is employed. It differs from diode laser 41 in that the beam is brought out through a length of fiber optic cable 56 which allows diode laser 51 to be installed near the rear portion of the baton handle to minimize mechanical shock on diode laser 51 when baton 50 is used as a striking instrument. A currently available commercial laser with integral fiber cable is OPC-A001-0670-FC manufactured by Opto-Power Corp. As with previous embodiments, current technology limits the available visible laser wavelength to the red portion of the wavelength spectrum at the present time, but those skilled in the art can appreciate use of a wider wavelength spectrum.

Because semiconductor diode laser 51 in laser baton 50 would typically be utilized briefly, a heat sink is not required. However, to position an output end of fiber optic cable 56 correctly relative to collimating lens 53, a fiber optic connector 58 (such as an SMA 905 connector from Amphenol Inc.) is necessary. Collimating lens 53, as in earlier embodiments, reduces the spread angle of the output beam to a predetermined, desired size. Because baton 50 is meant for use at closer ranges than flashlight laser 40, a larger beam spread angle from lens 53 is used. Again, a conventional short focal length (approximately 50 millimeters), double-convex lens 53, available from a number of commercial optical suppliers, is sufficient. Lens 53 can be anti-reflective coated at or near the laser wavelength if desired. Preferably, it should be made of plastic or similar compound to withstand use as a conventional baton.

Baton laser 50 is used in much the same way as flashlight laser 40. When a police officer is confronted by a threatening individual, the officer aims baton laser 50 at the adversary's chest, engages diode laser 51 with operator switch 54 and issues a verbal warning. If the adversary fails to surrender, the officer then directs laser beam 52 at the adversary's eyes to produce temporary visual impairment while the officer or his associates physically apprehend and handcuff the adversary. If the adversary has a firearm, laser beam 52 is continually directed towards the adversary's eyes to reduce his ability to aim and accurately fire his weapon.

Figure 7A:
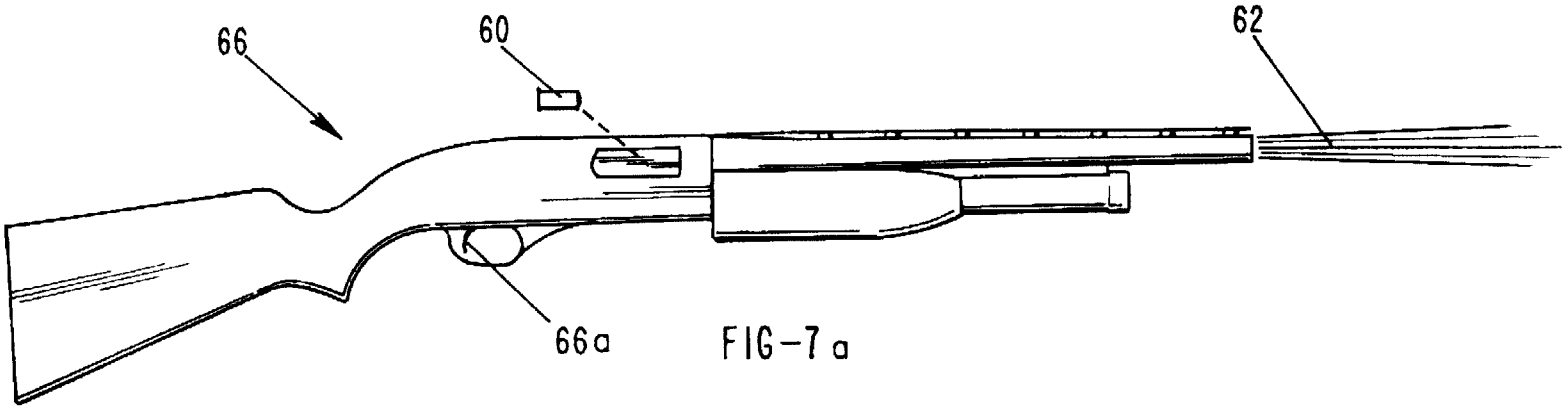
FIG. 7*a* is a side view of another alternate embodiment of the present invention in combination with a conventional shotgun.
Figure 7B:
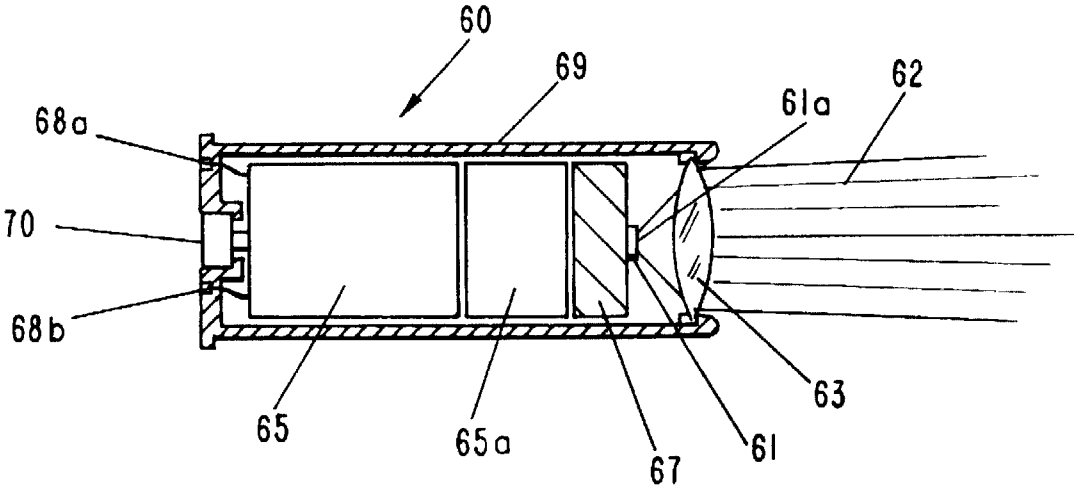
FIG. 7*b* is a cross-sectional side view of the embodiment shown in FIG. 7*a;*

Another alternate embodiment of the present invention is shown in FIGS. 7*a* and 7*b*. The component parts of the laser shotgun shell 60 include shell housing 69, power source 65, triggering generator 70, laser triggering and power supply circuit 65*a*, semiconductor diode laser 61, laser output aperture 61*a*, heat sink 67 and collimating lens 63.

Though other sizes could be used, housing 69 is the size and shape of a 12 gauge shotgun shell so that it fits into a conventional 12-gauge shotgun 66, exactly like a conventional shotgun shell. The functions of housing 69 are to protect the internal components, provide a rigid framework for mounting the optical components, and, by fitting snugly into the shotgun 66 barrel, produce laser beam 62 that is boresighted to the sights of shotgun 66. Housing 69 can be constructed of any rigid material such as aluminum, brass, or plastic.

A single nickel-cadmium rechargeable battery pack can serve as power source 65, and is contained in the rear of housing 69 to power diode laser 61. Battery pack 65 provides from 2 to 3.6 volts dc to laser power supply control circuit 65*a* and is recharged electrically by battery recharge contacts 68*a* and 68*b*. Because of the high current (approximately 1 ampere) required by the diode laser 61 and the extremely limited space available, nickel-cadmium battery technology is the preferred commercial choice. However, those skilled in the art can appreciate employing other portable power sources. In this application, battery pack 65 only has to power laser 61 for a total of 2 minutes or less (24 five-second "shots"), which means that battery 65 requires a capacity of approximately 33 milliampere-hours. There are several commercial firms that custom manufacture nickel cadmium battery packs for special applications that meet these requirements (e.g. Power-Sonic Corporation of Redwood City, Calif.).

Rather than being operated with an operator switch, as in the previous embodiments, the laser shotgun shell 60 is triggered by the action of the shotgun firing pin (not shown) striking a piezo-electric crystal 70 in the base of the shell. Piezo-electric crystals generate a pulse of electricity when struck mechanically. They are commonly used in flint-less butane lighters to produce a spark for igniting the gas. In the present embodiment the electrical pulse is used to engage diode laser 61, via the shotgun shell's triggering and power supply control circuit 65*a*.

The function of laser triggering and power supply control circuit 65*a* is twofold: (1) to operate diode laser 61 for a fixed length of time (5 seconds nominal) in response to a trigger signal from piezo-electric crystal 70; and (2) to provide current-limited power to the diode laser 61. The trigger portion of the circuit 65*a* is a conventional electronically integrated circuit called a monostable multivibrator, or "flip-flop." The time period for which the flip-flop stays turned "on" can be set during manufacture by selection of appropriate external resistors. Although a nominal five-second "on" time seems appropriate for a typical law enforcement operation, the shells could be manufactured with several different "on" times and color coded accordingly. It would even be possible to include a sub-miniature variable resistor that could be adjusted through a hole in the shell to provide a specific "on" time. The power supply control portion of circuit 65*a* is a relatively simple and compact circuit to limit the current to diode laser 61 to a non-destructive level. Because of the extremely limited space available in a shotgun shell, a full current-controlled power supply design such as that used in the flashlight laser and baton laser cannot be used here. Although sub-miniature electronic component technologies, such as surface-mount technology, must be used, the design is based on commercially available components.

Semiconductor diode laser 61 in this embodiment produces ¼ to ½ watt of visible light. In this embodiment, the semiconductor diode laser 61 differs from the other diode lasers described in the present invention in that it is not encased as a standard electronic component package. Instead, it is purchased in an unconventional package called a "C-mount", which is much smaller than other semiconductor laser diode packages. The C-mount allows the semiconductor laser diode 61 to be installed in the limited, smaller space of the shotgun shell which does not have access to an inherent heat-sinking capability (either within or outside of the shell). Therefore, internal heat sink 67 must be employed in this embodiment, even though diode laser 61 will only be engaged for short periods of time. A currently available commercial device in a C-mount package which meets these requirements is manufactured by Uniphase Corp. as model number HP-067-0500-C. As with the previous embodiments, current technology limits the available visible laser wavelength to the red portion of the wavelength spectrum.

The function of collimating lens 63 is, as in earlier embodiments, to reduce the spread angle of output beam 62 to a desired size. Because output beam 62 from a C-mount laser comes directly from diode laser 61 with no intervening fiber optic cable, beam 62 spreads much more in one axis than the other, typically 10 degrees in the narrow axis and 40 degrees in the wide axis. A custom-designed lens, available from any of several commercial firms, is necessary to compensate for this phenomenon.

Because laser shotgun shell 60 is most likely to be used in serious situation involving potential gun battles, its primary use will be as a visual impairment device rather than a warning and delay device. Officers armed with shotguns can add one or two laser shotgun shells 60 to their ammunition source prior to use. Laser shell 60 can be loaded as the first shell in the shotgun's magazine, or manually chambered during an operation as needed. In use, the officer aims shotgun 66 at an adversary's eyes and pulls the trigger 66*a*. Laser 61 stays on for several seconds to produce temporary visual impairment while the other officers physically apprehend and handcuff the adversary. If the adversary has a firearm, laser beam 62 will reduce his ability to aim and accurately fire his weapon. When necessary, laser shell 60 can be ejected and a conventional live ammunition round chambered and fired.

Figures 8, 8A:
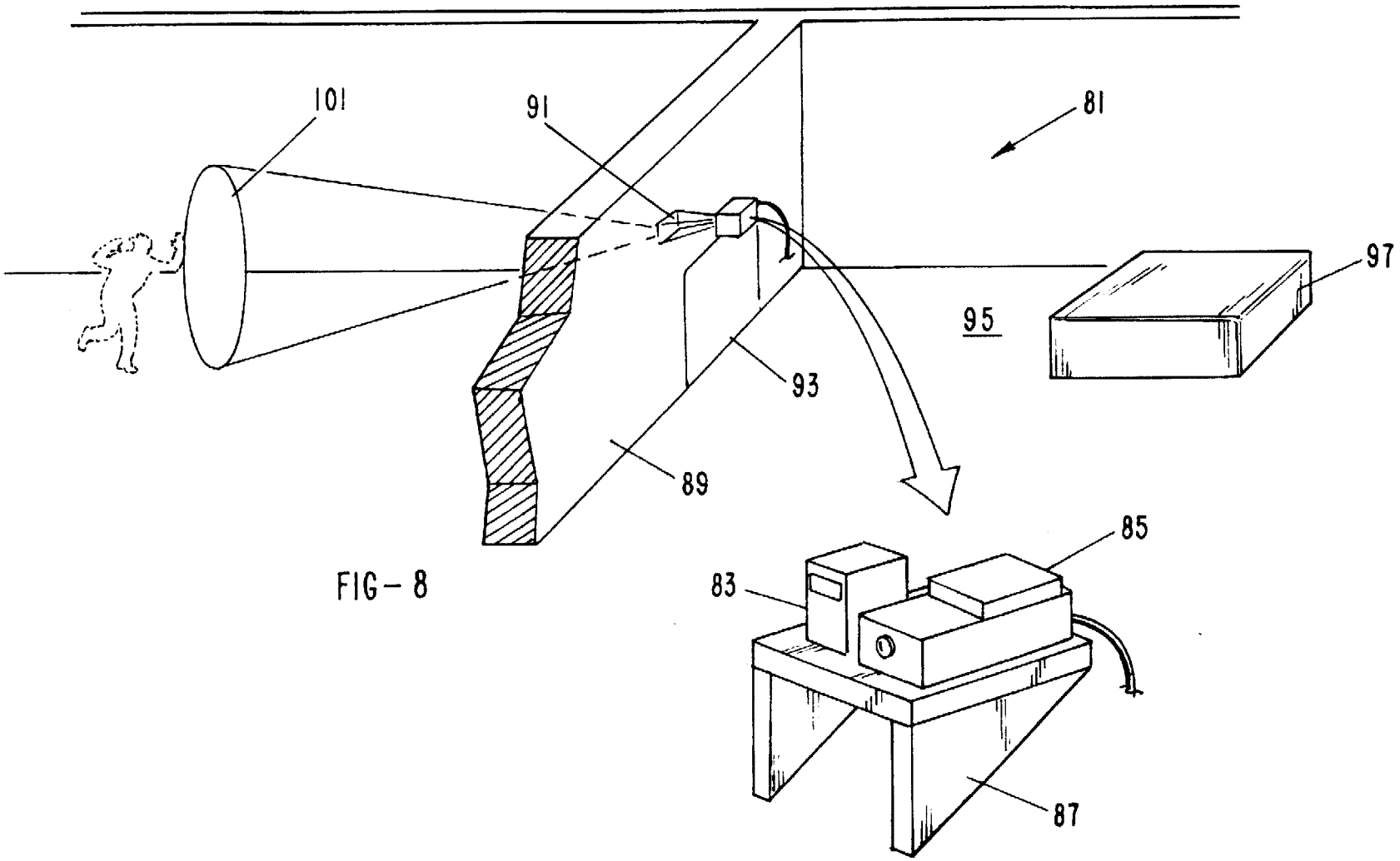
FIG. 8 is a perspective view of the fixed laser security system in an example application.
FIG. 8*a* is a perspective view of the fixed laser security system of FIG. 8.
Figure 8B:
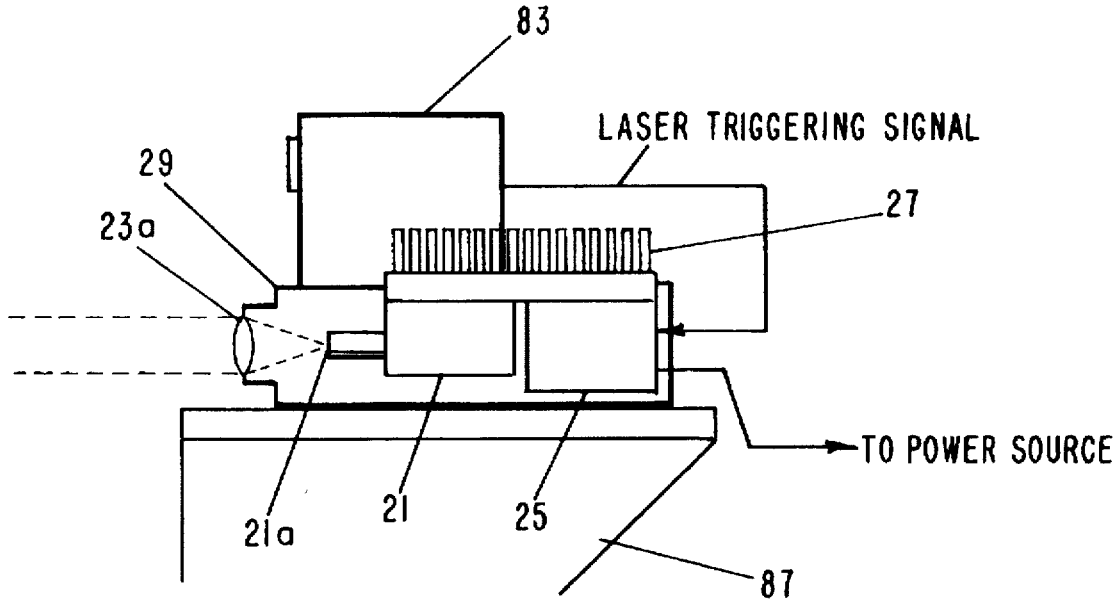
FIG. 8*b* is a side, partially cross-sectional view of the motion sensor and laser of the fixed laser security system of FIG. 8.

The fixed laser security system 81, shown in FIGS. 8, 8*a* and 8*b*, consists of a conventional intruder motion sensor 83, a laser unit 85, and a mounting bracket 87. Bracket 87 is, typically, secured to a wall 89 behind a window 91 positioned above (or adjacent to) door 93 which provides access to a secured area 95 and a "protected asset" 97. Motion sensor 83 is of convention design, such as used in a commercially available in conventional burglar alarm and security systems, (e.g. a Model 40-208 by the Radio Shack Division of Tandy Corporation). Laser unit 85 may be the same design as laser unit 20, and thus, include semiconductor laser diode 21, collimating lens 23*a*, power supply 25, heat sink 27, and housing 29. Lens 23*a* would be chosen to, typically, provide a 50–100 cm spot 101 at a predetermined distance based on the geometry of the facility. The motion sensor 83 and laser 85 would be armed when the facility security system itself was armed, typically at night when there are few people in the facility. Sensor 83 is coupled to laser unit 85 via cabling 103. Motion sensor, once armed, detects intruders approaching the secured area 95 and sends a triggering signal to the laser unit 85. This signal turns on the laser which illuminates the intruder to warn him that he has been detected and delay his or her advance by visual impairment as discussed above.

Whereas the drawings and accompanying description have shown and described the preferred embodiment of the present invention, it should be apparent to those skilled in the art that various changes may be made in the form of the invention without affecting the scope thereof.

What I claim is:

1. A self contained, portable device to reduce or temporarily impair the visual ability of a human by either glare or flashblinding without long-term visual impairment, said device comprising:

(a) a single housing;

(b) a laser positioned in said housing, said laser being a low energy laser, when energized said laser producing a beam of visible laser light having an intensity of up to 0.0583 watts/cm$^2$ at a range of 3–1000 meters;

(c) a lens positioned in said housing for altering the spread and, therefore, the intensity of said laser beam;

(d) a power source positioned in said housing;

(e) a switch positioned in said housing; and (f) a power source circuit positioned in said housing, interconnecting said power supply and said switch with said laser, said circuit limiting the power output of said laser to a level of intensity at which significant glare and flashblinding effects occur but below the threshold intensity for permanent eye damage.

2. The device as set forth in claim 1, wherein said laser is a continuous laser.

3. The device as set forth in claim 1, wherein said laser is a repetitively pulsed laser.

4. The device as set forth in claim 1, wherein said laser operates in the wavelength range of 400 to 700 nm.

5. The device as set forth in claim 4, wherein said laser is a frequency-doubled Nd:YAG laser.

6. The device as set forth in claim 4, wherein said laser is a semiconductor diode laser.

7. The device as set forth in claim 1, wherein said power source includes at least one battery.

8. The device as set forth in claim 1, further including means to adjust the position of said lens relative to the laser output aperture, whereby said beam spread can be altered so that the diameter of said beam and said intensity can be varied.

9. The device as set forth in claim 8, wherein said position adjusting means is a ring mounted on said housing.

10. The device as set forth in claim 9, wherein said housing has the general exterior configuration of a conventional flashlight.

11. The device as set forth in claim 10, wherein said power source is one or more conventional batteries.

12. The device as set forth in claim 11, further including a heat sink positioned in said housing in heat transfer relationship with said laser.

13. The device as set forth in claim 1, further including an optical fiber to couple said laser to said lens.

14. The device as set forth in claim 13, wherein said laser is a semiconductor diode laser.

15. The device as set forth in claim 14, wherein said housing has the general configuration of a police baton.

16. The device as set forth in claim 15, wherein said housing is a sturdy tube which can also function as a baton.

17. The device as set forth in claim 1, wherein said housing is the size and shape of a cartridge for a hand held firearm.

18. The device as set forth in claim 17, wherein said housing is size and shape of a conventional 12 gauge shotgun shell, whereby said housing can be chambered in a conventional 12 gauge shotgun.

19. The device as set forth in claim 18, wherein said switch generates a laser triggering signal upon impact by the firing pin of said shotgun.

20. The device as set forth in claim 19, wherein said switch is a piezo crystal triggering generator.

21. The device as set forth in claim 19, wherein said power supply circuit includes a triggering circuit.

22. The device as set forth in claim 18, wherein said power source is a rechargeable battery, and further including means for recharging said battery.

23. The device as set forth is claim 18, wherein said laser is a semiconductor diode laser.

24. The device as set forth in claim 23, further including a heat sink positioned in said housing in heat transfer relationship with said laser.

25. A device to reduce or temporarily impair the visual ability in a human by either glare or flashblinding, without long-term visual impairment, said device comprising:

(a) a low energy laser, when energized said laser producing a beam of visible laser light having an intensity of up to 0.0583 watts/cm$^2$at a range of 3–1000 meters, said laser including a housing and optics for altering the spread of said beam;

(b) a power source for energizing said laser;

(c) a switch;

(d) a power supply circuit interconnecting said power source and said switch with said laser, said circuit limiting the power output of said laser to a level at which significant glare and flashblinding effects can occur, but below the threshold intensity for permanent eye damage.

26. The device as set forth in claim 25, further including a closed circuit television camera and a remotely located operator monitor electronically coupled to said camera, said camera and said laser housing mounted adjacent to each other, so that both are at the same location, remote from said monitor.

27. The device as set forth in claim 26, further including a pan and tilt mount and electronics for controlling the movement of said mount, said camera and said laser both being secured to said mount, said monitor including a pan and tilt control.

28. The device as set forth in claim 27, wherein said switch is located on said monitor.

29. The device as set forth in claim 26, wherein said laser is a continuous laser.

30. The device as set forth in claim 26, wherein said laser is a repetitively pulsed laser.

31. The device as set forth in claim 26, wherein said laser operates in the wavelength range of 400 to 700 nm.

32. The device as set forth in claim 31, wherein said laser is a frequency doubled Nd:YAG laser.

33. The device as set forth in claim 31, wherein said laser is a semiconductor diode laser.

34. A device to reduce or temporarily impair the visual ability in a human by either glare or flashblinding, without long-term visual impairment, said device comprising:

(a) a low energy laser, when energized said laser producing a beam of visible laser light having an intensity of no more than 0.0583 watts/cm$^2$ at a location a fixed distance from said laser along the path of said beam, said laser including a housing and optics for setting the spread of and, hence the intensity, of said beam;

(b) a power source for energizing said laser;

(c) means for sensing the presence of a moving individual within a predetermined are, said sensing means including a switch; and (d) a power supply circuit interconnecting said power and said switch with said laser, said circuit limiting the power output of said laser to a level of intensity at which significant glare and flashblinding effects can occur, but below the threshold intensity for permanent eye damage.

* * * * *